US005165532A

United States Patent [19]

Pipich et al.

[11] Patent Number: 5,165,532

[45] Date of Patent: Nov. 24, 1992

[54] CIRCUIT BREAKER WITH INTERLOCK FOR WELDING CONTACTS

[75] Inventors: Charles W. Pipich, Monroeville; William E. Beatty, Jr., Brighton Township, Beaver County, both of Pa.

[73] Assignee: Westinghouse Electric Corp., Pittsburgh, Pa.

[21] Appl. No.: 706,720

[22] Filed: May 29, 1991

[51] Int. Cl.[5] ..... H01H 5/25

[52] U.S. Cl. ..... 200/401; 200/327; 200/DIG. 42; 335/24; 335/166; 335/168

[58] Field of Search ..... 200/401, 318, 323, 324, 200/325, 326, 327, 43.16, DIG. 42; 337/47, 48, 49, 50, 70; 335/166, 167, 168, 169, 170, 171, 172, 173, 174, 175, 9, 10, 22, 23, 24

[56] References Cited

U.S. PATENT DOCUMENTS 3,525,959 8/1970 Ellsworth et al. ..... 335/166
3,605,052 9/1971 Dimond et al. ..... 355/166
3,614,685 10/1971 Ellsworth et al. ..... 335/166
3,849,747 11/1974 Mrenna et al. ..... 335/166
4,165,453 8/1979 Hennemann ..... 200/401
4,368,444 1/1983 Preuss et al. ..... 200/401 X
4,630,019 12/1986 Maier et al. ..... 337/70
4,679,016 7/1987 Ciarcia et al. ..... 335/9

*Primary Examiner*—Henry J. Recla
*Assistant Examiner*—Glenn T. Barrett
*Attorney, Agent, or Firm*—M. J. Moran

[57] ABSTRACT

A circuit breaker includes an interlock which prevents movement of the handle to the off position when the contacts are welded closed. The interlock includes a pair of floating links which jam between slots in arms of the yoke of a spring powered operating mechanism which carries the handle, and recesses in the rotatable cross-bar carrying the movable contact arms. The recesses are offset from the rotational axis of cross-bar so that an attempt to move the switch to the off position generates a moment which will break open lightly welded contacts.

12 Claims, 6 Drawing Sheets

FIG. 1.
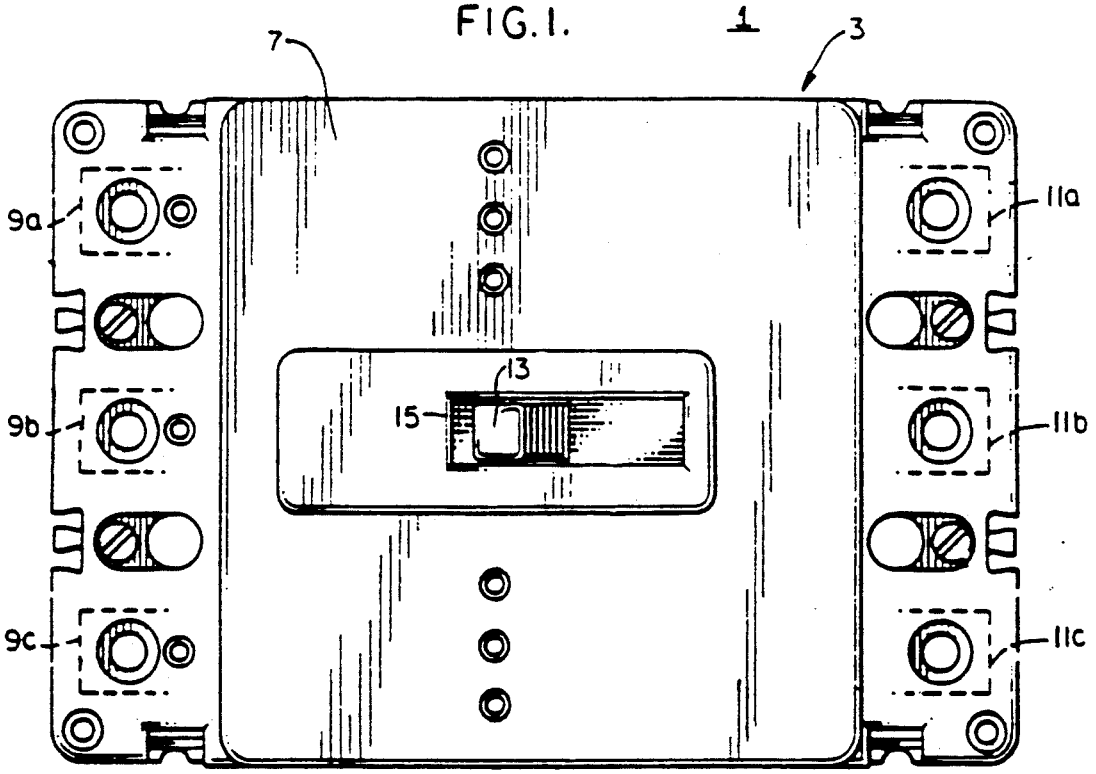
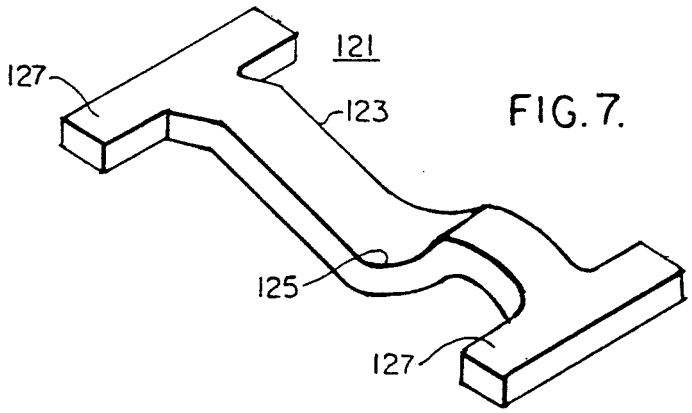
FIG. 7.

CIRCUIT BREAKER WITH INTERLOCK FOR WELDING CONTACTS

CROSS REFERENCE TO RELATED APPLICATIONS

Commonly owned, concurrently filed on May 29, 1991 U.S. patent application entitled "Circuit Breaker with Positive On/Off Interlock" whose inventors are Henry R. Beck and Charles W. Pipich and is identified by application Ser. No. 706,713.

Commonly owned, concurrently filed on May 29, 1991 U.S. patent application entitled "Circuit Breaker for Welded Contacts" whose inventors are Yu Wei Chou and Henry K. Pruszynski and is identified by application Ser. No. 706,714.

Commonly owned, U.S. patent application Ser. No. 508,812 entitled "Circuit Breaker Positive Interlock" filed Apr. 3, 1990 by D. A. Parks, T. A. Whitaker, and Y. W. Chou.

BACKGROUND OF THE INVENTION

1. Field of the Invention

This invention relates to a circuit breaker in which the handle is blocked from movement to the off position when the contacts are welded closed.

2. Background Information

A common type of circuit breaker has a fixed electrical contact, and a movable electrical contact mounted on a movable contact arm. The contacts are closed and opened by rotating a handle between an on and off position, respectively. A latchable cradle connected to the movable contact arm by a spring operated toggle device is held in a latched position by a trip device. In response to predetermined overload conditions in the circuit breaker, the trip mechanism unlatches the latchable cradle and the spring operated toggle device rotates the movable contact arm to open the contacts. When the circuit breaker is tripped in this manner, the spring operated toggle device also moves the handle to a trip position intermediate the on and off positions. Thus, the handle provides a visual indication of the state of the circuit breaker. The circuit breaker is reset by moving the handle slightly past the off position to relatch the latchable cradle, and then to the on position to reclose the contacts.

It is possible under some overload conditions for the contacts of a circuit breaker to become welded closed. Under these circumstances, the trip device of the circuit breaker described above can respond to the overload condition by unlatching the latchable cradle. If the weld is of sufficient strength, the contact arm cannot be rotated and the contacts remain closed. However, it is possible to rotate the handle to the off position to relatch the cradle.

Several remedies for this condition have been proposed. In U.S. Pat. No. 3,525,959, the cradle is latched by a latch member which is engaged by the trip mechanism. To reset a tripped circuit breaker of this type, the knee pivot of the toggle which forms part of a spring loaded operating mechanism which trips the breaker, engages the latch member as the handle is moved to the off position to relatch the cradle. When the breaker is tripped, but the contacts are welded closed, the toggle remains erected and does not engage the latch member to relatch the cradle when the handle is moved to the off position. Thus, the cradle cannot be reset and the springs of the actuating mechanism maintain the handle in the on position when released indicating the true condition of the contacts.

In one embodiment of the circuit breaker of U.S. Pat. No. 3,614,685, a blocking member on the movable contact arm structure prevents the cradle from moving to a position at which it can be relatched by the trip mechanism when the handle is moved to the off position following a trip with the contacts welded closed. In another embodiment of this circuit breaker, a latch on the cradle engages a stationary part to prevent rotation of the cradle to the relatched position following a trip with the contacts welded closed. In both embodiments, the springs bias the handle to the on position under these conditions to indicate the real position of the welded contacts.

In U.S. Pat. No. 4,630,019, a handle yoke latch prevents rotation of the handle to the reset position if the contacts are welded closed. When the contacts are not welded closed, the movable contact arm structure rotates the handle yoke latch out of the path of the handle yoke to permit a tripped circuit breaker to be reset.

While the circuit breakers in U.S. Pat. Nos. 3,525,959 and 3,614,685 prevent relatching of the cradle following a trip with the contacts welded closed, and bias the handle to the on position to show that the contacts remain closed, the handle can still be moved to the off position. In some applications, circuit breakers are operated remotely by a motor operator. If the handle can be moved to the off position even though biased to the on position, the motor operator could hold the handle in the off position providing an indication that the contacts of the circuit breaker were open when in fact they were welded closed. In addition, in some installations, the circuit breaker is mounted in a cabinet with the handle mechanism extending through the cabinet door wall for external operation. It is possible for such a handle mechanism to have sufficient friction that the handle could remain in the off position despite the spring bias in the circuit breaker to the open position when the contacts were welded closed. In some installations, a hasp lock is provided to lock the circuit breaker in the off position. If the handle can be moved to the off position with the contacts welded closed, it is possible for the handle to be locked in the off position when in fact the contacts are welded closed. Obviously, this is not a satisfactory condition.

U.S. Pat. No. 3,849,747 discloses a miniature circuit breaker with a latchable cradle which is connected by a spring to a movable contact arm which in turn is connected to a handle. Since the handle is connected directly to the contact arm, it cannot be moved to the off position if the contacts are welded closed, and correspondingly, the handle cannot be relatched.

Commonly owned U.S. patent application Ser. No. 07/511,700, entitled "Circuit Breaker with Positive Indication of Welded Contacts" and filed on Apr. 20, 1990 discloses a circuit breaker in which an interference device in the form of a pin on a cross-bar joining the movable contact arm associated with each phase of the circuit breaker engages the operating member incorporating the handle to prevent rotation of the handle to the off position when the contacts are welded closed.

It is the primary object of the present invention to provide a circuit breaker with an improved arrangement for preventing movement of the operating handle to the off position when the contacts are welded closed.

It is another object of the present invention to provide such improved circuit breaker in which an attempt to move the handle to the off position with the contacts welded closed, produces a force which will break open lightly welded contacts.

SUMMARY OF THE INVENTION

This and other objects are realized by the invention which is directed to an electrical circuit breaker having a fixed contact, and a movable contact carried by a movable contact arm structure. A spring powered operating mechanism, which includes a pivoted operating member carrying a handle, rotates the movable contact arm structure between an on position of the handle in which the movable contact arm structure is in a closed position to close the contacts, and an off position of the handle in which the movable contact arm structure is in an open position to open the contacts. A trip device actuates the spring powered operating mechanism to rotate the movable contact arm structure to the open position and place the handle in a tripped position between the on and off positions in response to predetermined current overload conditions. The circuit breaker is provided with an interlock which includes floating interlock means floating between the pivoted operating member and the movable contact arm structure as the movable contact arm structure rotates between the open and closed positions and the pivoted operating member pivots as the handle moves between the on and off positions. The floating interlock member jams between the movable contact arm structure and the pivoted operating member blocking pivoting of the handle to the on position when the contacts are welded closed.

More particularly, the floating interlock member is a rigid elongated member. The operating member has a slot in which one end of the rigid elongated member slides. The movable contact arm structure has a recess in which the other end of the rigid elongated member seats. The recess in the movable contact arm structure rotates away from the slot in the operating member to allow pivoting of the operating member carrying the handle toward the off position as the contacts open with the rotation of the movable contact structure to the open position. However, the rigid elongated member jams in the slot to block pivoting of the operating member to the off position when the recess in the movable contact arm structure is prevented from rotating by welding the contacts closed.

The movable contact arm structure includes movable contact arms for each movable contact and a common cross-bar which rotates about a longitudinal axis. The recess in which the elongated floating interlock member seats is provided in the cross-bar and is located laterally of the longitudinal axis about which the cross-bar rotates so that when the contacts are welded closed and the elongated member jams in the slot in the operating member, an attempt to move the handle to the off position generates a moment on the cross-bar which will break open weak welds of the contacts.

BRIEF DESCRIPTION OF THE DRAWINGS

A full understanding of the invention can be gained from the following description of the preferred embodiment when read in conjunction with the accompanying drawings in which:

FIG. 1 is a plan view of a circuit breaker incorporating the invention.

FIG. 7 is an isometric view of an insert which forms one feature of the invention.

DESCRIPTION OF THE PREFERRED EMBODIMENTS

Figure 2:
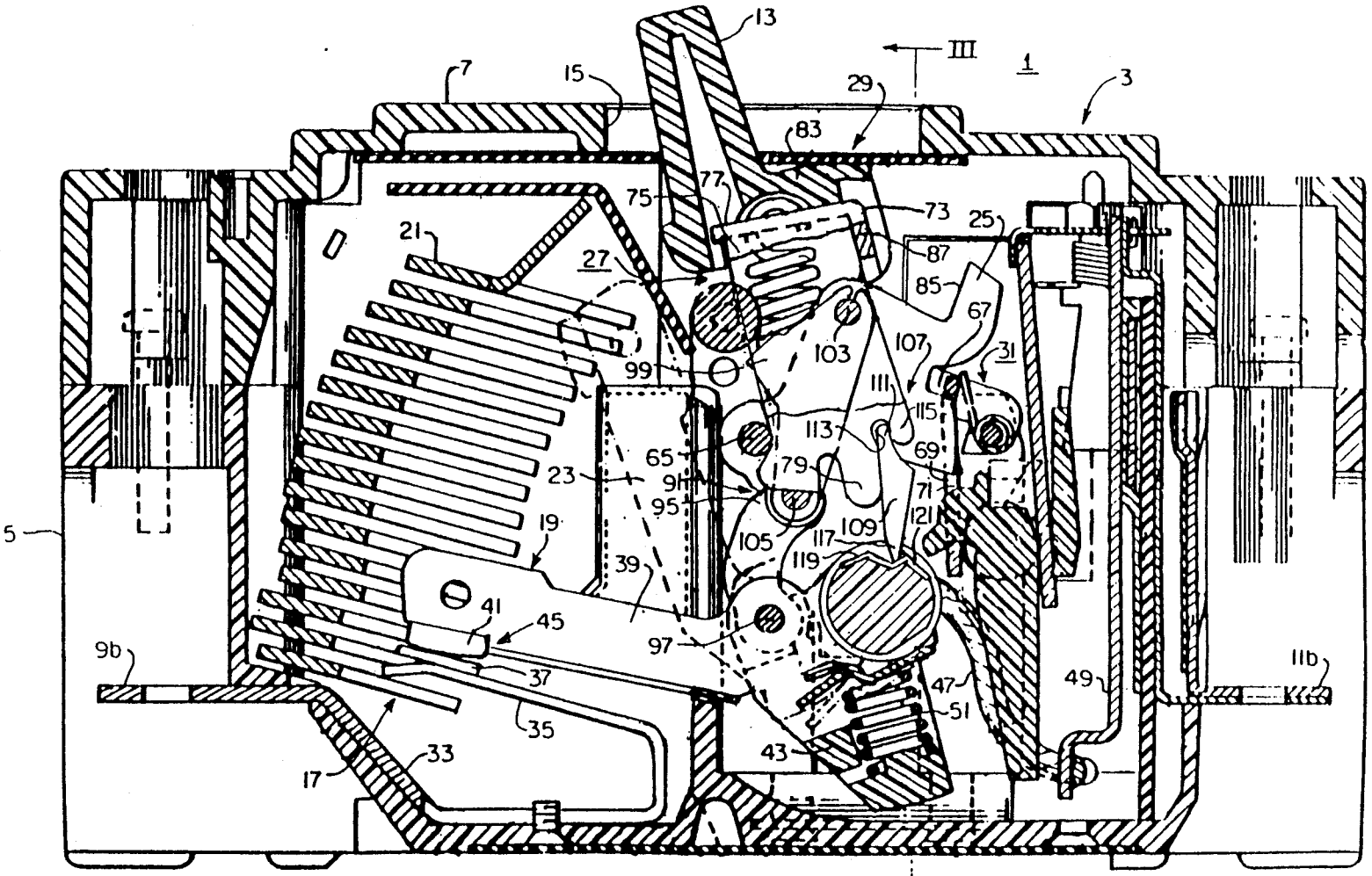
FIG. 2 is a longitudinal vertical section taken along the line II—II of the circuit breaker of FIG. 1 shown in the on or closed position with some parts broken away.

The drawings show a new and improved circuit breaker 1 incorporating the invention. The circuit breaker 1 is of the type described in U.S. Pat. No. 4,630,019 which is hereby incorporated by reference for providing full details of the basic circuit breaker.

While the invention is shown as applied to a three phase circuit breaker, it will be evident to those skilled in the art that the invention has equal applicability to single phase or other multiphase circuit breakers, including three-phase circuit breakers with a neutral line.

As shown in FIG. 1, the circuit breaker 1 includes a molded, electrically insulating enclosure 3 comprising a base 5 (see FIG. 2) and a removable cover 7. A set of input terminals 9*a*, 9*b* and 9*c*, one for each pole, and a set of output terminals 11*a*, 11*b* and 11*c*, are provided to connect the circuit breaker 1 into, in this instance, a three phase electrical system to be protected by the circuit breaker. A handle 13 for manually opening and closing the circuit breaker, and for indicating the state of circuit breaker extends through an opening 15 in the cover 7.

Turning to FIG. 2, which is a cross section through the center pole with some parts broken away, circuit breaker 1 includes for each pole a lower contact structure 17, a movable contact structure 19, an arc chute 21 to aid in extinguishing the electrical arc created by the interrupting current through the pole, and a slot motor 23 to aid in accelerating interruption of the current. The major components of the circuit breaker 1 also include a common latchable cradle 25, a spring operated actuating mechanism 27, an operating member 29 and a trip mechanism 31 which is responsive to predetermined overcurrent conditions in each pole.

The lower contact structure 17 includes a stationary conducting member 33, the outer end of which constitutes the input terminal 9 for the respective pole. The stationary conducting member 33 has a cantilevered inner end 35 which carries a fixed electrical contact 37.

The movable contact structure 19 includes a movable contact arm 39 carrying at its outer end a movable electrical contact 41. Each of the movable contact arms 39 is mounted on a common transverse cross-bar 43 for simultaneous rotational movement between a closed position shown in FIG. 2 and an open position shown in FIG. 4. The fixed electrical contact 37 and the movable electrical contact 41 form a set of contacts 45 which are closed to complete an electrical circuit through the circuit breaker when the contact arm is in the closed position, and to interrupt current through the respective pole of the circuit breaker when the contact arm is in the open position. A flexible conductor 47 is connected between the movable contact arm 39 and a bimetal 49 which in turn is connected to the respective output terminal 11.

The movable contact arms 39 for the three poles are pivotally connected to the common cross-bar 43 and are biased by compression springs 51 mounted in recesses within the cross-bar. These compression springs 51 insure that the movable contact arms 39 move in unison with the cross-bar 43 and apply a predetermined closing force to the set of contacts 45. They also permit the electrical contacts 45 to rapidly separate when blown open by a high level short circuit without waiting for the operating mechanism to sequence.

Figure 3:
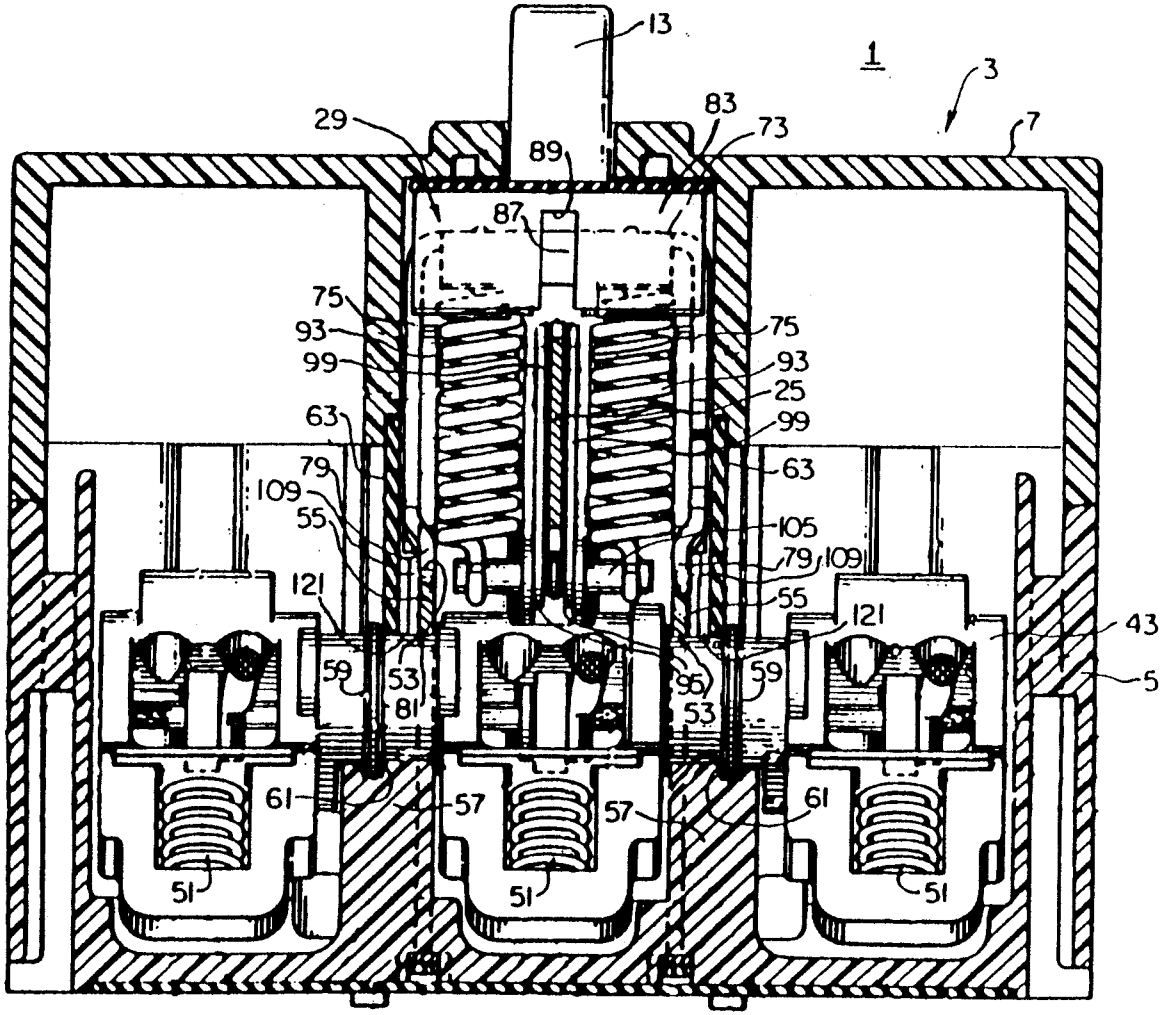
FIG. 3 is a transverse vertical section through the circuit breaker of FIG. 2 taken generally along the line III—III.

As best seen in FIG. 3, the common cross-bar 43 is journaled for rotation in apertures 53 in spaced apart side plates 55 secured in partitions 57 in the molded base 5 of the circuit breaker. Axial movement of the cross-bar is restrained by integral flanges 59 which are engaged by grooves 61 in the partitions 57. Insulating panels 63 electrically isolate the poles of the circuit breaker 1.

Referring again to FIG. 2, the latchable cradle 25 is mounted for rotation about one end by a cradle pin 65 supported by the side plates 55. The free end of the latchable cradle includes a slot or groove defining a latching surface 67. This latching surface 67 engages a slot 69 in a latch plate 71 which forms part of the trip mechanism 31.

The operating member 29 includes a U-shaped yoke 73 having a pair of spaced apart parallel arms 75 (with the near arm 75 partially broken away in FIG. 2) joined by a web 77. As is best seen in FIG. 3, arcuate free ends of tabs 79 inwardly offset from the lower ends of the operating member arms 75 are received in and rotate in arcuate recesses 81 in the side plates 55. The operating member 29 includes the handle 13 having an integrally molded base 83 which is secured to the yoke 73. The handle 13, and with it the yoke 73, are movable between the on position shown in FIG. 2 and an off position shown in FIG. 4. They are also positionable to a trip position shown in FIG. 5 which is intermediate the on and off positions. The cradle 25 includes a yoke contacting surface 85 configured to contact a flange 87 on the web 77 through a slot 89 in the molded base 83 on the handle 13. (See FIGS. 2 and 3.) The contact surface 85 on the cradle 25 contacts the flange 87 to position the handle to the tripped position when the trip mechanism releases the cradle. When the handle 13 is moved past the off position, the flange 87 contacts the surface 85 to rotate the cradle 25 for relatching.

The spring operated actuating mechanism 27 includes a toggle device 91 and a pair of helical tension springs 93. The toggle device 91 includes a pair of lower toggle arms 95 straddling the movable contact arm 39 of the center pole and pivotally connected thereto by a lower toggle pin 97. The toggle device 91 further includes a pair of upper toggle arms 99 straddling the latchable cradle 25 and having engaging an upper toggle pin 103 extending through and connected to the cradle 25. The upper and lower pairs of toggle arms 99 and 95 are pivotally connected together by a toggle knee pin 105. The pair of helical tension springs 93 are stretched between the web 77 of the yoke 73 and the toggle knee pin 105 outside the upper toggle arms 99.

With the handle 13 in the on position, the line of action of the springs 93 is to the left of the upper toggle pin 103, as viewed in FIG. 2, to rotate the toggle knee pin 105 in the clockwise direction relative to pin 103. With the latching cradle 25 engaged by the intermediate latch plate 71, the lower toggle arms 95 are rotated in a counterclockwise direction relative to pin 97 to rotate the cross-bar 43, and therefore, each of the movable contact arms 39, in the counterclockwise direction to the closed position wherein the electrical contacts 45 are closed.

Upon the occurrence of predetermined overcurrent conditions in one of the poles of the circuit breaker 1, the trip device 31 (such as the device described in detail in U.S. Pat. No. 4,630,019) is operated to rotate the latching plate 71 out of engagement with the latching surface 67 on the latchable cradle 25. With the cradle 25 unlatched, the springs 93 acting through the toggle knee pin 105, upper toggle arms 99 and upper toggle pin 103, rapidly accelerate the latchable cradle 25 in the counterclockwise direction as viewed in FIG. 2. This shifts the line of action of the tension springs 93 behind the toggle pin 103 causing the toggle mechanism to collapse thereby raising the toggle knee pin 105, and through the lower toggle arms 95, the lower toggle pin 97. Raising of the lower toggle pin 97 rotates the cross-bar 43 in the clockwise direction thereby raising all of the movable contact arms 39 to simultaneously open the sets of contacts 45 for each pole of the circuit breaker. As this occurs, any electrical arc struck across the sets of contacts 45 are extinguished by the arc chutes 21. As the toggle device 91 breaks, with the upper toggle arms 99 rotating counterclockwise and the lower toggle arms 95 rotating clockwise, the yoke 73 carrying the handle 13 is moved to the intermediate position shown in FIG. 5 by the rotating cradle 25 which contacts the flange 87 on the yoke. This positioning of the handle between the off and on positions provides a visual indication that the circuit breaker 1 has tripped.

Figure 4:
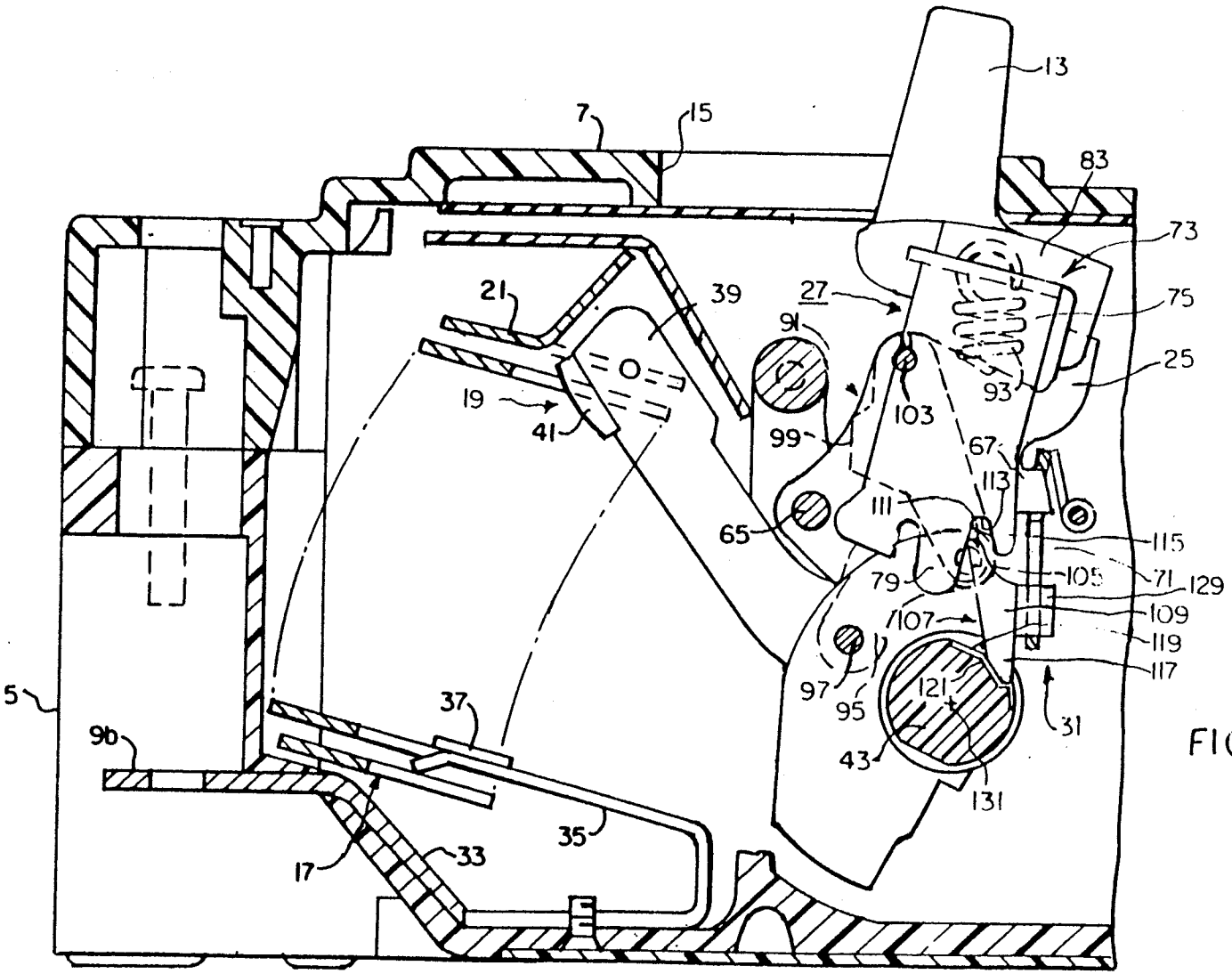
FIG. 4 is a fragmentary view similar to the view of FIG. 2 showing the circuit breaker in the normal open or off position.
Figure 5:
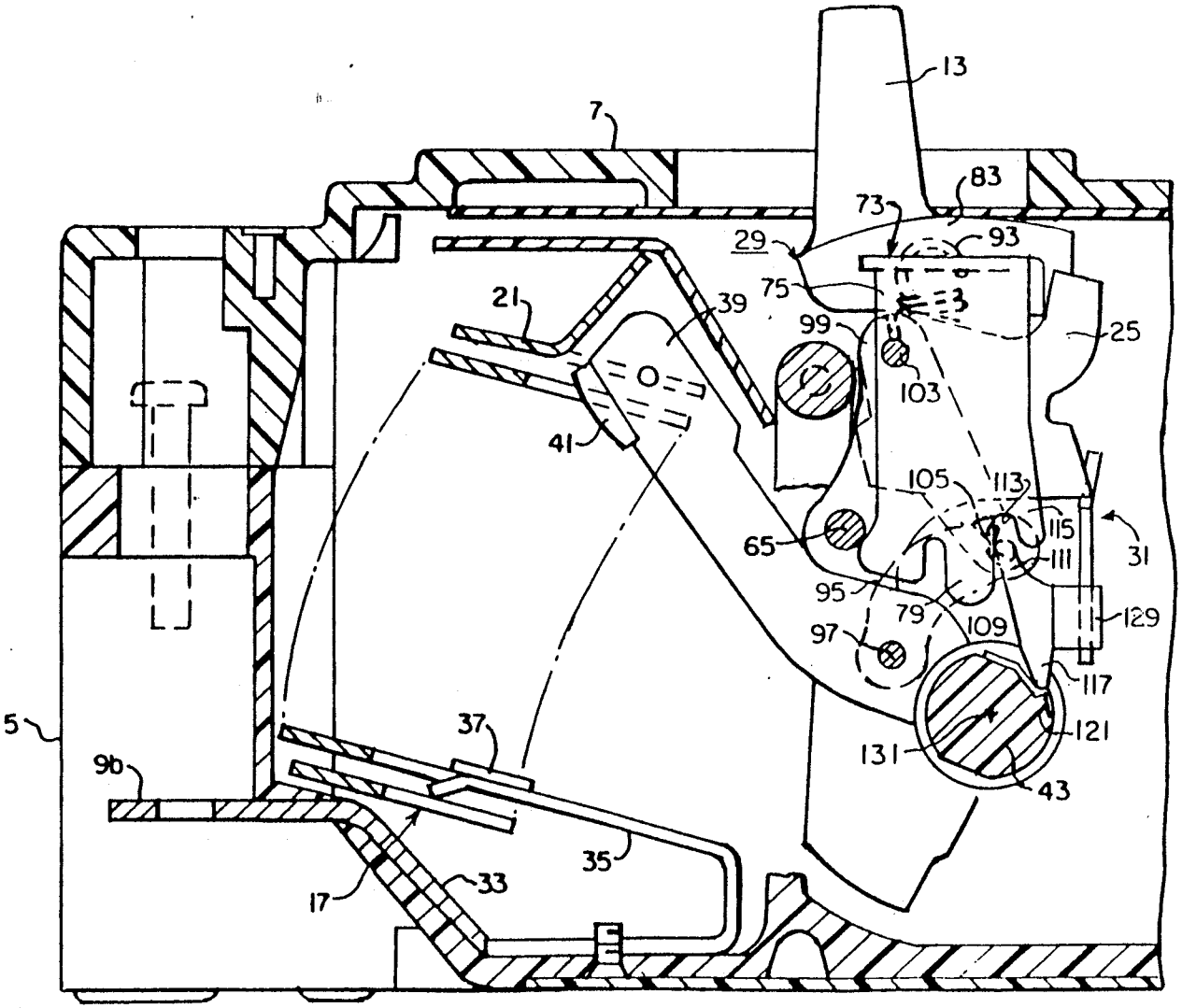
FIG. 5 is a fragmentary view similar to FIG. 2 showing the circuit breaker in the normal trip position.

To reset the circuit breaker the handle 13 is moved toward, and slightly past the off, or full clockwise position, as viewed in FIG. 4. As the handle is brought to this reset position, the flange 87 on the yoke 73 bears against the surface 85 on the latchable cradle 25 to rotate the cradle clockwise until the latching surface 67 engages the intermediate latch plate 71 of the trip mechanism 31. Movement of the handle to this position causes the line of action of the springs 93 to move to the right of the toggle pin 103 so that the handle remains in the off position.

To again close the circuit breaker, the handle 13 is moved from the off position shown in FIG. 4 to the on position shown in FIG. 2. When the line of action of the springs 93 passes to the left of the upper toggle pin 103, the toggle device 91 is erected and the cross-bar 43 is rotated counterclockwise to close the sets of electrical contacts 45 as previously described.

If the set of contacts 45 of any one of the poles of the circuit breaker 1 is welded closed, the associated contact arm 39, and therefore, the cross-bar 43 and the other movable contact arms 39, cannot be rotated. Thus, the contacts 45 for all of the poles remain closed. In the case of a trip, even though the latchable cradle 25 is released by the latch plate 71, the handle 13 remains in the on position because the toggle knee pin 105 is prevented from rising by the welded contacts, and hence, the toggle device remains erected. Without the present invention, however, it would still be possible to move the handle 13 to the off position although it would spring back to the on position when released since the line of action of the springs 93 could not be moved to the right of the upper toggle pin 105. As previously mentioned, however, this is not a satisfactory condition where the handle 13 is operated remotely by a motor driven operator or by a handle extension when a circuit breaker is mounted within an enclosure, or when the possibility of locking the handle in the off position using a hasp lock exists.

Figure 8:
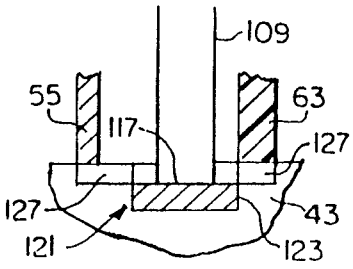
FIG. 8 is a fragmentary vertical section in enlarged scale of a portion of FIG. 3.

In accordance with the invention, an interlock 107 is provided to prevent rotation of the handle 13 to the the off position when the contacts 45 are welded closed. The interlock 107 includes a pair of floating links 109 extending between the yoke 73 of the operating member 29 and the cross-bar 43. One end 111 of the floating links 109 slides in a slot 113 formed between an extension 115 and the tab 79 on the free end of the arms 75 of the yoke 73. The second end 117 of the floating links 109 are seated in recesses 119 in the cross-bar 43. As best seen in FIG. 3, the recesses 119 are aligned with the yoke arms 73. Preferably, inserts 121 are provided in the recesses 119 in the cross-bar 43. The inserts 121, shown separately in FIG. 7, have an elongated center section 123 which is bent to form an indentation 125 in which the lower end 117 of one of the floating links 109 seats. Each end of the center section 123 of the inserts 121 is provided with a transverse flange 127. These transverse flanges (as can be seen from FIG. 8 which is an enlarged section of FIG. 3) extend under the side plates 55 and insulating panels 63 to retain the inserts 121 in the recesses 119. The inserts 121 which are preferably made of metal distribute the load imposed on the molded cross-bar by the floating links when an attempt is made to move the handle to the open position with the contacts welded closed in the manner which will be discussed. The inserts 121 also prevent wear on the recesses in the molded cross-bar 43. Wall sections 129 molded into the base 5 (see FIG. 4) retain the floating links 109 in the slots 113 and recesses 119.

In the normal on position, with the contacts closed, the floating links are positioned as shown in FIG. 2 with the upper ends 111 of the floating links extending upward into the slots 113 in the yoke arm 75. When the handle is operated to the off position, the yoke 73 of the operating member 29 is rotated clockwise as seen in FIG. 2 to the position shown in FIG. 4. As the operating member is rotated, the toggle device 91 rotates the center contact arm 39 clockwise to rotate the cross-bar 43 clockwise which carries with it the remaining contact arms. Rotation of the cross-bar 43 clockwise moves the recesses 119 downward relative to the yoke 73. The floating links 109 follow the recess and the cross-bar thereby allowing clearance for the yoke to be rotated to the off position of the handle. Similarly, if a trip occurs, the toggle mechanism 91 rotates the cross-bar 43 to open the contacts and also positions the operating member to place the handle in the trip position shown in FIG. 5. Again, in this position, the rotation of the recesses and the cross-bar 43 allow the floating links to move downward to provide clearance in the slots 113 for rotation of the operating member to the trip position.

Figure 6:
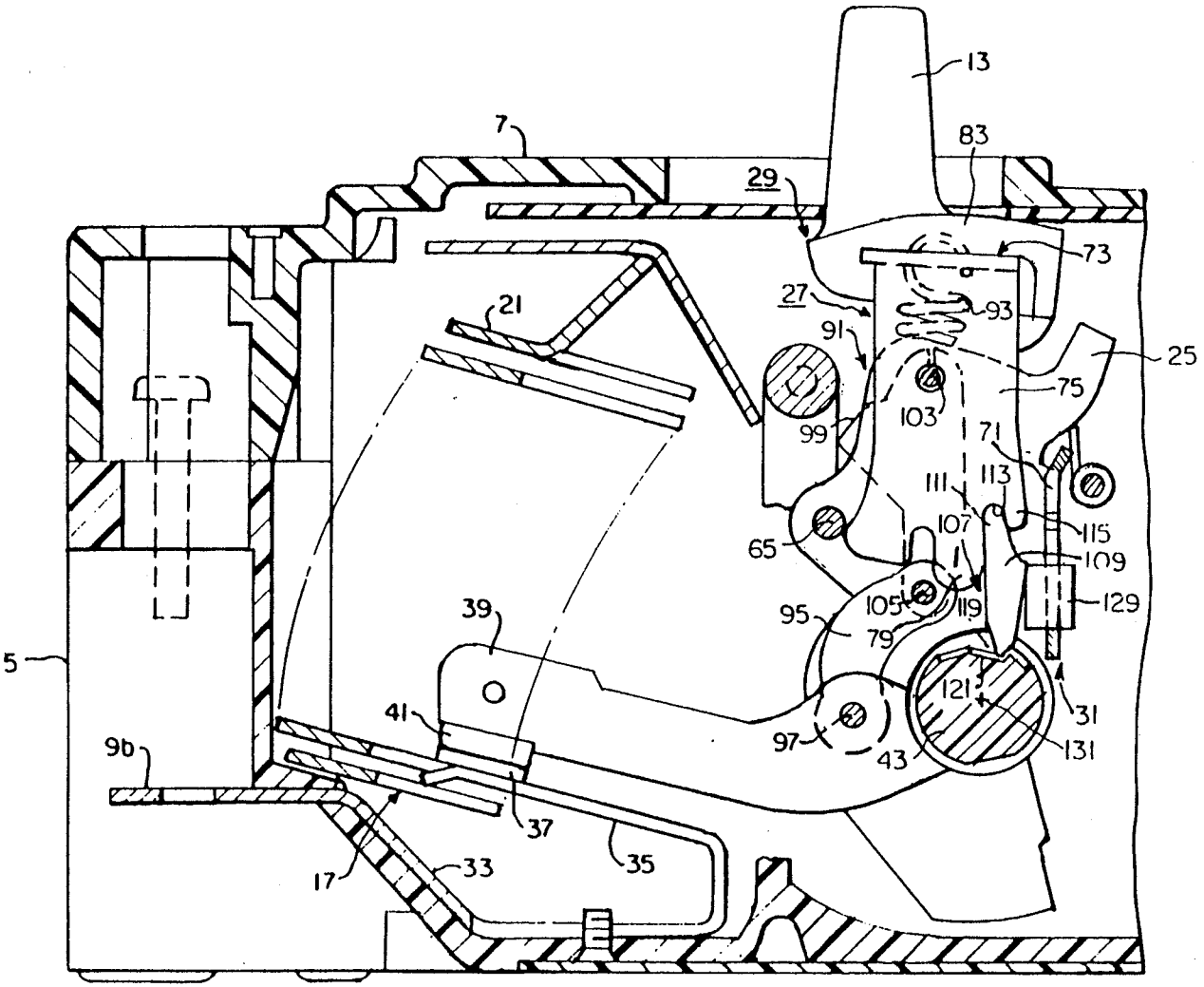
FIG. 6 is a fragmentary view similar to FIG. 2 showing the circuit breaker tripped with the contacts welded closed.

However, if the contacts are welded closed, and an attempt is made to move the handle 13 to the off position, the cross-bar 43 cannot rotate. Thus, the floating links 109 cannot move downward and their upper ends 111 jam in the slots 113 to prevent rotation of the operating member and therefore the handle to the off position as shown in FIG. 6. The dimensions of the floating links 109 or recesses 121 in slots 113 are such that the yoke 73 can only pass three degrees past the over center position of the toggle mechanism 91. The operating member 29 can not remain in this position; however, when the handle is released as the toggle mechanism 91 biases the handle to the on position, thereby providing a visual indication of the true state of the contacts 45.

The recesses 119 in the cross-bar 43 are positioned with respect to the longitudinal axis 129 of the cross-bar 43 such that as the floating links 109 jam in the slots 113, a force applied in an attempt to move the handle to the on position creates a moment on the cross-bar tending to rotate the cross-bar in the clockwise direction as viewed in the figures. This clockwise moment on the cross-bar 43 applies an opening force to the contacts 45 which may be sufficient to break light welds and thereby opening the contacts and permitting the handle to be rotated to the off position.

This simple but effective means to mechanically block movement of the handle to the off position when the circuit breaker contacts welded closed, only requires minor modifications to the circuit breaker in the form of the floating links, the slots in the operating member yoke arm, the recesses in the cross bar, and, if desired, the inserts in the recesses. This particular interlock also provides the additional advantage of being able to break light welds, and therefore maintain uninterrupted operation of the circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical circuit breaker, comprising:

a housing;

a fixed contact mounted in said housing;

a movable contact mounted in said housing and closable upon said fixed contact;

a movable contact arm structure having a recess carrying said movable contact and rotatable between open and closed positions to open and close said contacts;

a spring powered operating mechanism having an elongated slot and including a pivoted operating member carrying a handle, said operating mechanism connected to said movable contact arm structure for rotating said movable contact arm structure between an on position of said handle in which said movable contact arm structure is in the closed position to close said contacts and an off position of said handle in which said movable contact arm structure is in the off position to open said contacts;

a trip device responsive to predetermined current overload conditions in the circuit breaker connected to said spring powered operating mechanism for causing said spring powered operating mechanism to rotate said movable contact arm structure to the open position and to place the handle in a trip position between said on and said off positions;

said trip device being reset by moving said handle past said off position; and floating interlock member comprising a rigid elongated member slidable within said elongated slot of said operating member and seated in said recess of said movable contact arm structure, said recess of said movable contact arm structure rotating away from said slot in said operating member to allow pivoting of said operating member carrying said handle toward said off position as said contacts open with rotation of said movable contact arm structure to said open position, said elongated member jamming in said slot to block pivoting of said operating member to said off position when said recess in said movable contact arm structure is prevented from rotating by welding of said contacts.

2. The circuit breaker of claim 1 wherein said movable contact arm structure comprises a cross-bar mounted for rotation about a longitudinal axis and a movable contact arm mounted on said cross-bar for rotation therewith and carrying said movable contact, and wherein said recess is in said cross-bar and forms a seat for said other end of said elongated member which is offset from said longitudinal axis of said cross-bar to generate through said rigid elongated member jammed in said slot in the operating member, a moment tending to rotate said cross-bar to open said welded contacts when an attempt is made to move the handle to the off position with the contacts welded closed.

3. The circuit breaker of claim 2 wherein said cross-bar is molded from a resin and including a hard insert placed in said recess and against which said other end of said rigid elongated member bears.

4. The circuit breaker of claim 3 wherein said cross bar is journaled in an aperture in a support plate and wherein said hard insert includes an extension extending into said aperture to retain said insert in the recess in said cross-bar.

5. The circuit breaker of claim 2 wherein said pivoted operating member comprises a handle yoke having a pair of spaced apart yoke arms with free ends about which said handle yoke pivots, each of said yoke arms having a slot and said cross-bar having a pair of recesses aligned with said slots in said yoke arms, said interlock including a pair of said rigid elongated members each having one end sliding in the slot in one of said yoke arms and the other end seated in one of the recesses in said cross-bar.

6. A multiphase electrical circuit breaker, comprising:

a housing;

a fixed contact for each phase mounted in said housing;

a movable contact for each phase mounted in said housing and closable upon said fixed contact for the respective phase;

a movable contact arm for each phase carrying the movable contact for the respective phase;

a common cross-bar mounted for rotation about a longitudinal axis and to which each movable contact arm is connected for rotation therewith between open and closed positions to open and close said contacts;

a spring powered operating mechanism including a handle;

a handle yoke carrying said handle and having a pair of spaced apart yoke arms having free ends about which said handle yoke pivots;

said operating mechanism connected to one of said movable contact arms for rotating said one movable contact arm and through said cross-bar the other movable contact arms between an on position of said handle in which said movable contact arms are in the closed position to close said contacts and an off position of said handle in which said movable contact arms are in said open position to open said contacts;

a trip device connected to said operating mechanism and responsive to predetermined overcurrent conditions to actuate said operating mechanism for causing said operating mechanism to rotate said movable contact arm to said open position and to place said handle in a trip position intermediate said on and said off position;

said trip device being reset by moving the handle past said off position; and interlock means including generally longitudinal slots in said yoke arms adjacent said free end thereof, a pair of recesses in said cross-bar aligned with said slots in said yoke arms, and a pair of rigid elongated members each having one end slidable in the slot in one of the yoke arms and having the other end seated in one of said recesses in said cross-bar, said recess rotating away from said slots in said yoke arms to allow pivoting of said handle yoke carrying said handle toward said off position as said contacts open with rotation of said movable contact arms to said open position, said rigid elongated members jamming in said slots to block pivoting of said handle yoke to said off position of said handle when said recesses in said cross-bar are prevented from rotating by welding of said contacts, said recesses being off-set from said longitudinal axis of said cross-bar to generate through said rigid elongated members jammed in said slots in said yoke arms a moment tending to rotate said cross-bar to open said welded contacts when an attempt is made to move the handle to said off position with said contacts welded closed.

7. An electrical circuit breaker, comprising;

a housing;

a first electrical contact mounted in said housing;

a second electrical contact mounted in said housing and engagable with said first electrical contact;

a movable contact arm mechanism carrying said second electrical contact;

spring powered operating means connected to said movable contact arm mechanism for moving said movable contact arm mechanism for bringing said electrical contacts into engagement and out of engagement;

an operating handle connected to said spring powered operating means and movable between an off position whereby said contacts are out of engagement and an on position whereby said contacts are engaged;

trip means connected to said spring powered operating means for causing said spring powered operating means to being said electrical contacts out of engagement; and a floating interlock member floating in contact with said spring powered operating means and said movable contact arm mechanism for jamming between said movable contact arm mechanism and said spring powered operating means thereby blocking movement of said handle to said off position when said contacts are welded in engagement.

8. The electrical circuit breaker as recited in claim 7, wherein said movable contact arm mechanism has a recess in which said floating interlock member sits.

9. The electrical circuit breaker as recited in claim 8, wherein said recess of said movable contact arm mechanism is lined with a metallic insert to prevent wear of said recess.

10. The electrical circuit breaker as recited in claim 8, wherein said floating interlock comprises a rigid elongated member.

11. The electrical circuit breaker as recited in claim 10, wherein said spring powered operating means includes a pivoted operating member, said pivoted operating member comprising a handle yoke having a pair of spaced apart yoke arms with free ends about which said handle yoke pivots, each of said yoke arms further having a slot in which said floating interlock member sits.

12. The electrical circuit breaker as recited in claim 10, wherein said floating interlock cooperates with said recess in said movable contact arm mechanism for tending to disengage said contacts when said contacts are welded together.

* * * * *